US011149420B1

(12) United States Patent
Grant et al.

(10) Patent No.: US 11,149,420 B1
(45) Date of Patent: Oct. 19, 2021

(54) SPLASHLESS SINK

(71) Applicants: Daniel Keith Grant, Reading, PA (US); Randon Brooks Bennett, Mohnton, PA (US); Thomas Ross Alexander Nichol, Mohnton, PA (US); Zachary Douglas Engle, Morgantown, PA (US)

(72) Inventors: Daniel Keith Grant, Reading, PA (US); Randon Brooks Bennett, Mohnton, PA (US); Thomas Ross Alexander Nichol, Mohnton, PA (US); Zachary Douglas Engle, Morgantown, PA (US)

( * ) Notice: Subject to any disclaimer, the term of this patent is extended or adjusted under 35 U.S.C. 154(b) by 20 days.

(21) Appl. No.: 16/274,528

(22) Filed: Feb. 13, 2019

Related U.S. Application Data

(60) Provisional application No. 62/630,166, filed on Feb. 13, 2018.

(51) Int. Cl.
*E03C 1/14* (2006.01)

(52) U.S. Cl.
CPC ..... *E03C 1/14* (2013.01)

(58) Field of Classification Search
CPC ..... E03C 1/14
See application file for complete search history.

(56) References Cited

U.S. PATENT DOCUMENTS

| | | | | |
|---|---|---|---|---|
| 1,709,545 | A | 4/1929 | Sheppard | |
| 2,508,808 | A | 5/1950 | Warman | |
| 4,773,436 | A * | 9/1988 | Cantrell | A47L 15/0092 134/108 |
| 5,452,484 | A | 9/1995 | Hill | |
| 7,578,305 | B2 * | 8/2009 | Bigott | A47L 15/0092 134/108 |
| 2013/0145562 | A1 * | 6/2013 | Lee | D06F 39/088 8/137 |
| 2017/0314242 | A1 * | 11/2017 | Nogoshi | C25B 9/06 |

* cited by examiner

*Primary Examiner* — Christine J Skubinna
(74) *Attorney, Agent, or Firm* — Joseph E. Maenner; Maenner & Associates, LLC

(57) ABSTRACT

A splashless sink assembly includes a bottom, an open top located above the bottom, a first side wall extending upwardly from the bottom to the open top at an angle oblique relative to the bottom, and a second side wall disposed opposite the first side wall. The second side wall extends upwardly from the bottom to the open top at an angle oblique relative to the bottom.

9 Claims, 5 Drawing Sheets

SPLASHLESS SINK

CROSS-REFERENCE TO RELATED APPLICATION

The present application claims the benefit of U.S. Provisional Patent Application Ser. No. 62/630,166, filed on Feb. 13, 2018, which is incorporated herein by reference in its entirety.

BACKGROUND OF THE INVENTION

Field of the Invention

The present invention relates to a sink that reduces or eliminates splashing of water out of the sink during use.

Description of the Related Art

Washing dishes at home splashes water on the countertop creating a mess that is time consuming to clean up. Splash guards have been invented that can be inserted at the back of a sink and extend upwardly to a height that will prevent the splashing of water over the top of the sink and toward the back of the sink. Such splash guards are unsightly to see and ungainly to use.

It would be beneficial to provide a sink in which the washing water is provided from within the sink itself, thereby reducing or even eliminating the splashing of wash water out of the sink.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a sink with a plurality of spray nozzles incorporated into the side walls of the sink. Additionally, the side walls of the sink extend at an inverted oblique angle relative to the vertical to further trap wash water emitted from the nozzles in the sink, thereby reducing or eliminating the splashing of wash water out of the sink.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
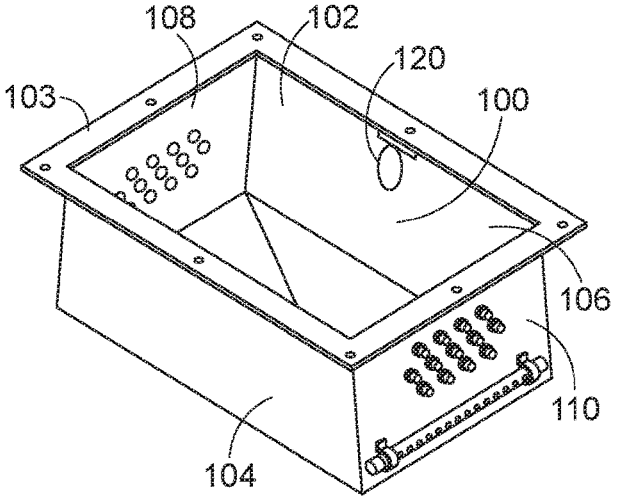
FIG. 1 is a perspective view of a sink according to an exemplary embodiment of the present invention.
Figure 2:
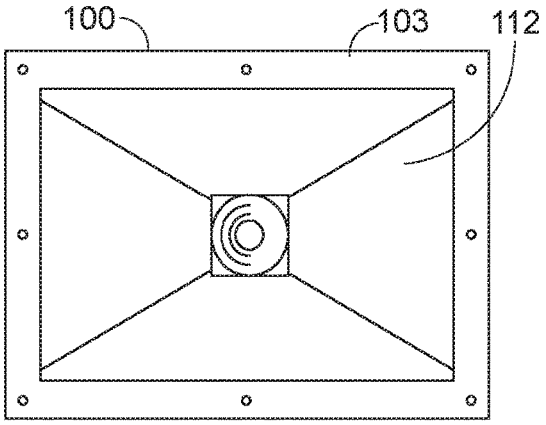
FIG. 2 is a top plan view of the sink of FIG. 1.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Referring to the Figures, a sink 100 according to an exemplary embodiment of the present invention is shown. Sink 100 can include standard plumbing features, such as, for example, an upright faucet 50 (shown in FIG. 5) or a sprayer 52 (shown in FIG. 9). Sink 100 also includes features that reduce splashing while washing items in sink 100.

Referring to FIGS. 1-5, sink 100 includes an open top 102, a front wall 104, a rear wall 106, a left side wall 108, a right side wall 110, and a bottom 112. Front wall 104, rear wall 106, left side wall 108, right side wall 110, and bottom 112 form a basin. Top 102 extends at least partially over a perimeter of the basin to catch splashing water and prevent the water from exiting sink 100. Water that hist the underside of top 102 gravity drains downwardly to bottom 112.

Figure 3:
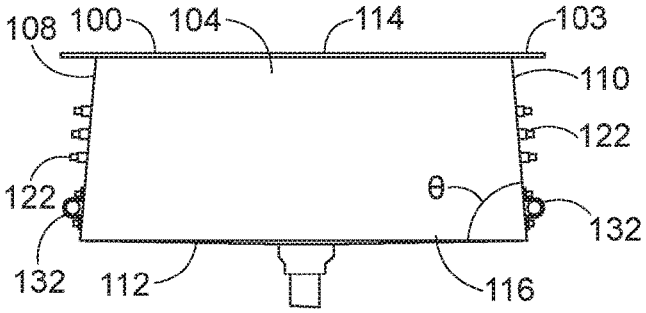
FIG. 3 is a front elevational view of the sink of FIG. 1.

Side walls 108, 110 of the sink 100 extend at an inverted oblique angle θ relative to the vertical to trap wash water emitted from nozzles in the sink 100, thereby reducing or eliminating the splashing of wash water out of the sink 100. As shown in FIG. 3, angle θ can be about 82 degrees, although those skilled in the art will recognize that angle θ can be other values, as long as angle θ is an acute angle.

A flange 103 extends around the perimeter of top 102 so that sink 100 can be attached to a counter surface by attaching the flange 103 to the counter surface. As shown in FIG. 3, front wall 104 is generally trapezoidal in shape, with a top edge 114 having a first length and a bottom edge 116 having a second length, longer than the first length. In an exemplary embodiment, front wall 104 extends in a generally vertical plane.

Rear wall 106 is similar to front wall 104 and, in an exemplary embodiment, extends in a plane parallel to the plane of front wall 104. Optionally, instead of the faucet 50 shown in FIG. 5, rear wall 106 can also or alternatively include a water supply opening 120 to allow a secondary water source to provide water to sink 100.

Figure 4:
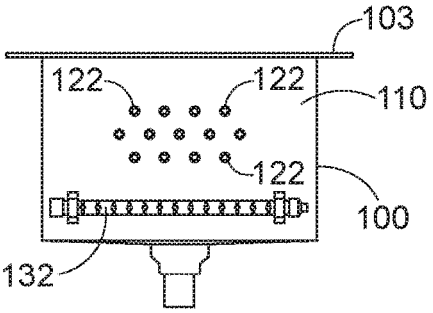
FIG. 4 is a left side elevational view of the sink of FIG. 1.
Figure 5:
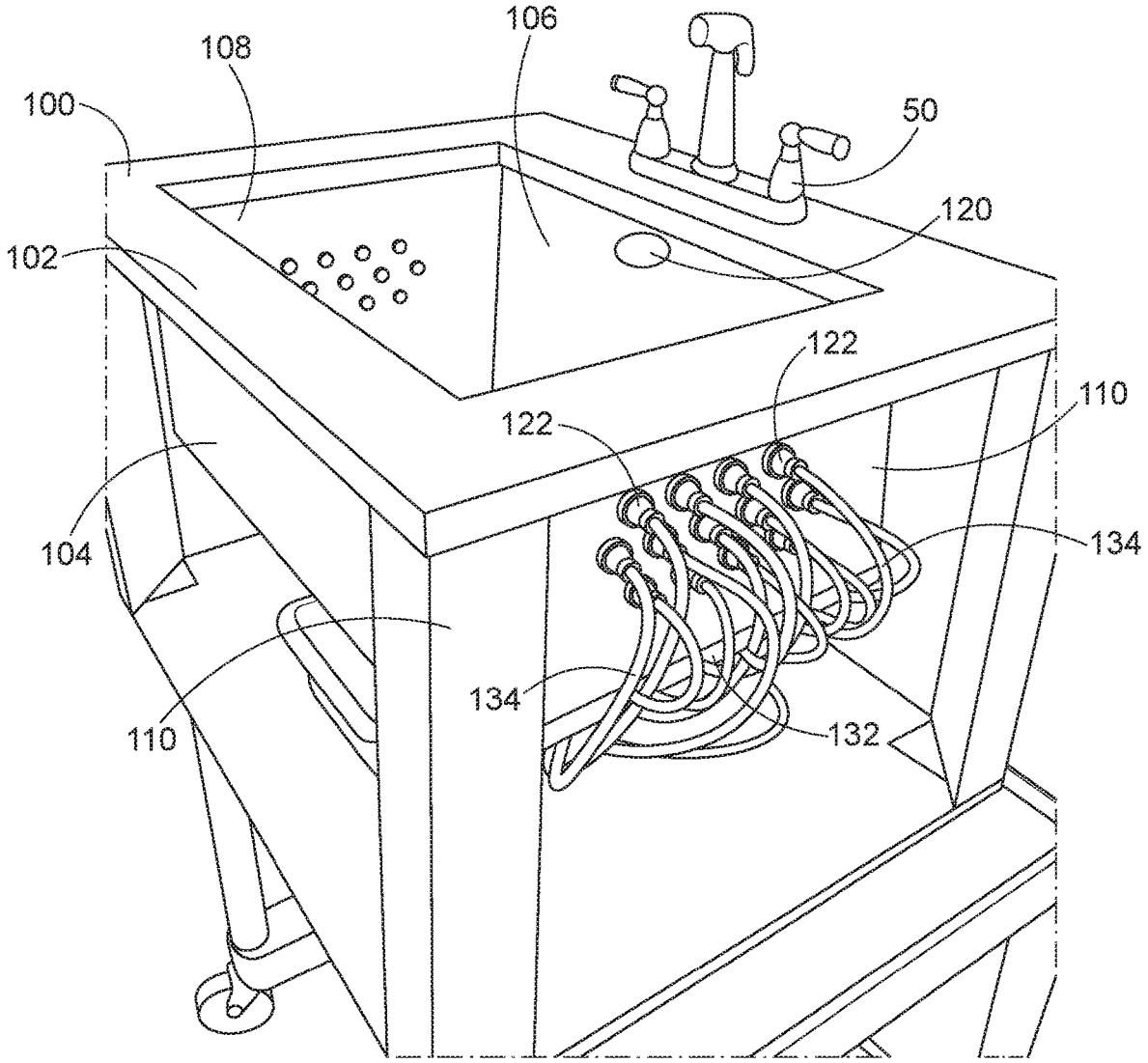
FIG. 5 is a perspective view of the sink of FIG. 1, mounted on a stand and plumbed.
Figure 7:
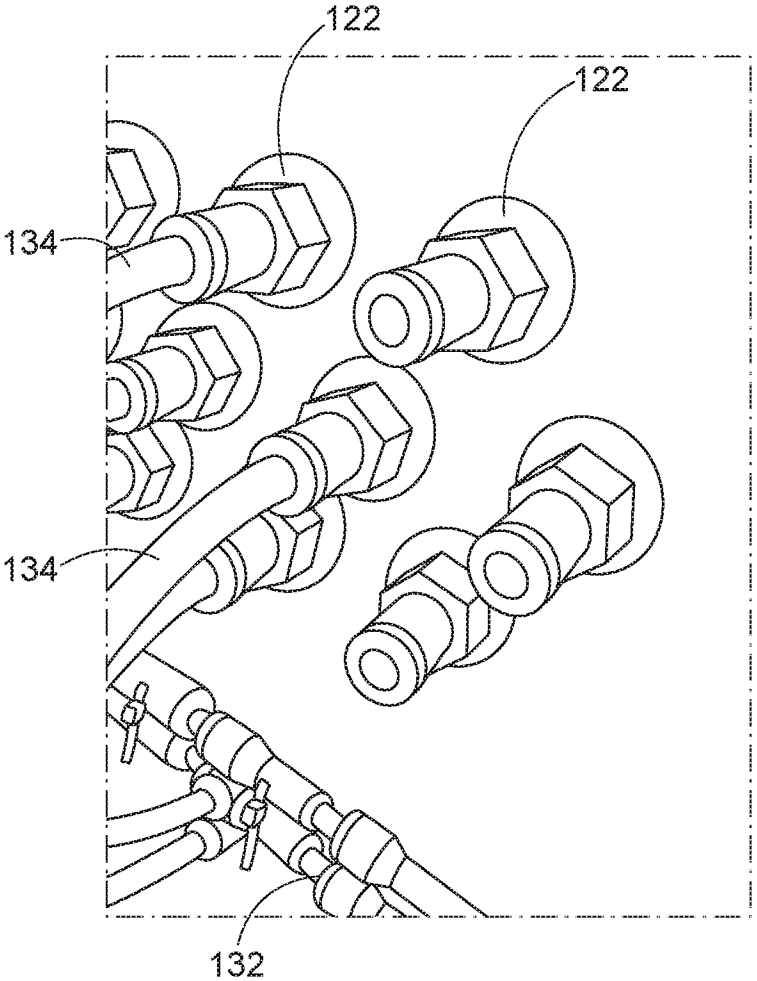
FIG. 7 is a perspective view of an outer side wall of the sink of FIG. 1, showing nozzle connections and plumbing tubing.
Figure 6:
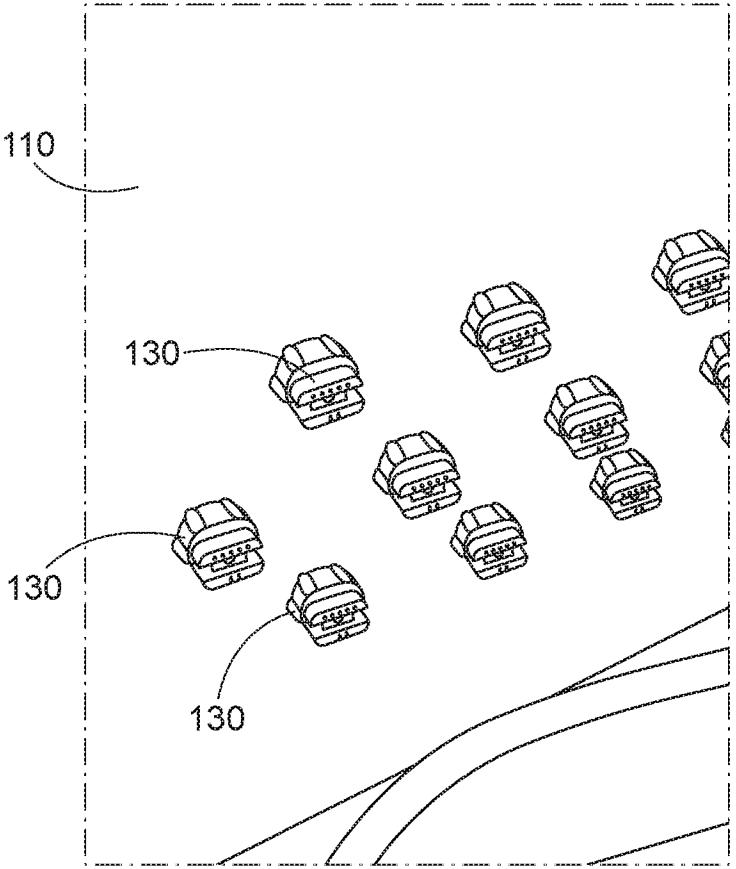
FIG. 6 is a perspective view of an inner side wall of the sink of FIG. 1, showing nozzles.
Figure 8:
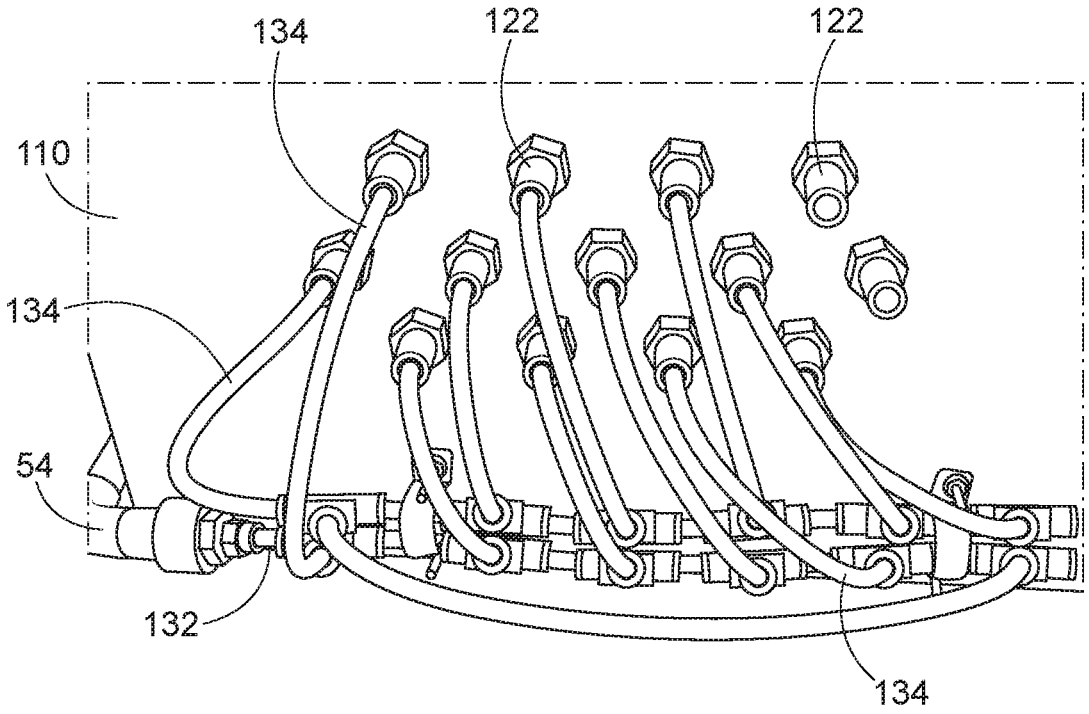
FIG. 8 is a side elevational view of the sink of FIG. 1, showing plumbing connections.

In an exemplary embodiment, the arrangement of left side wall 108 and right side wall 110 is generally identical, so only right side wall 110 will now be described. Referring to FIGS. 4 and 7, right side wall 110 includes a plurality of water discharge connections 122 that extend through wall 110 and terminate in nozzles 130 on the inside of sink 100 on right side wall 110, as shown in FIG. 6. Water discharge connections 122 are in fluid communication with a manifold 132, which is, in turn, in fluid communication with a pressurized water supply 54 (shown in FIG. 8). Referring to FIGS. 5 and 7, connector hoses 134 provide the fluid communication between manifold 132 and water discharge connections 122.

In an exemplary embodiment, nozzles 130 in left wall 108 and nozzles 130 in right wall 110 are offset so that, when water is flowing from nozzles 130 in both left wall 108 and right wall 110, the water stream from left wall 108 does not impact the water stream from right wall 110, which can result in water from the water streams deflecting upward and splashing out of sink 100.

As shown in FIG. 3, both left side wall 108 and right side wall 110 taper inwardly from the bottom 112 upwardly, such that left side wall 108 and right side wall 110 do not extend vertically. This inward taper directs water streams from nozzles 130 in a generally downward direction, and also provides a surface for redirected water to encounter, rather than splash out the top of sink 100.

While only left side wall 108 and right side wall 110 do not extend vertically, those skilled in the art will recognize that front wall 104 and rear wall 106 can also be tapered inwardly as well.

Figure 9:
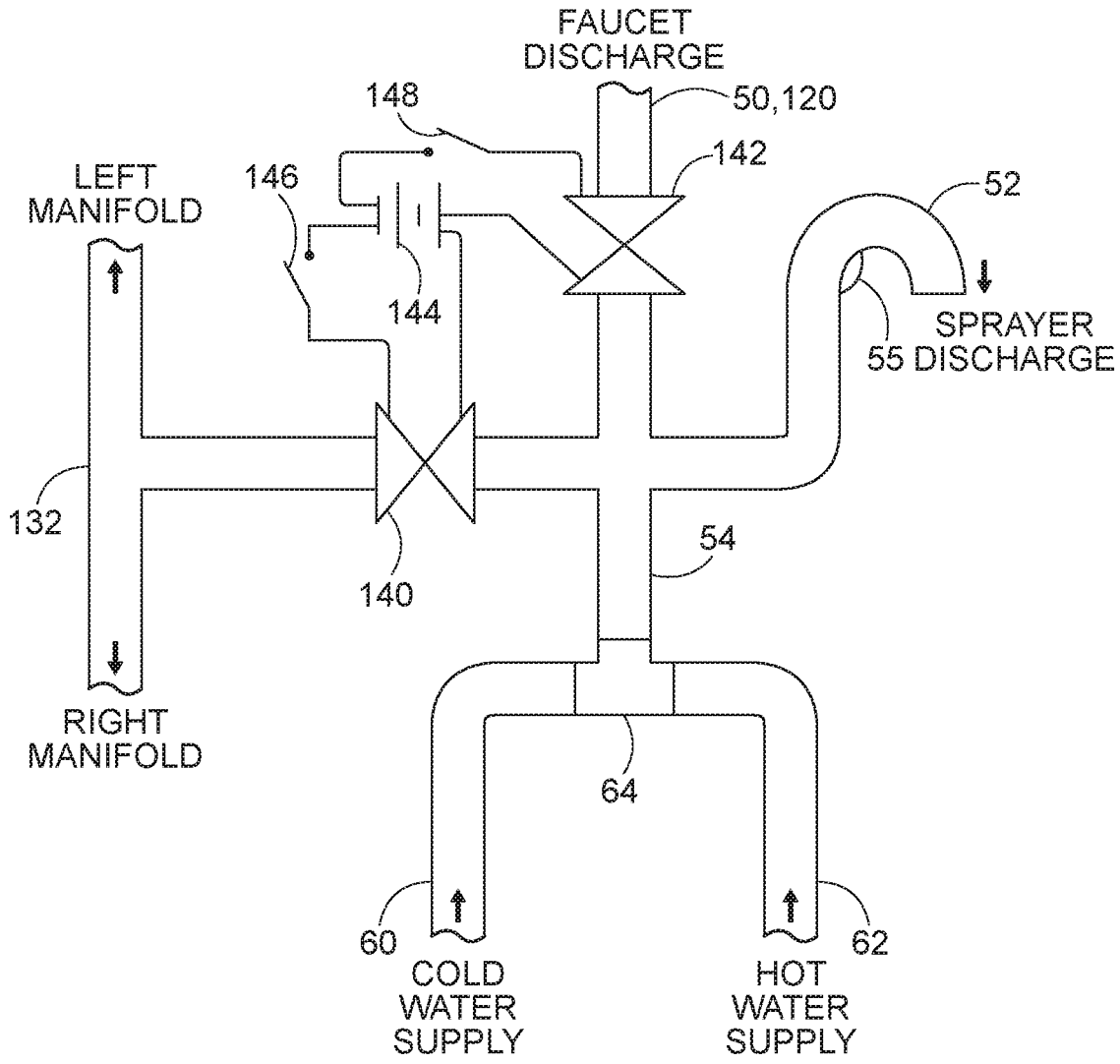
FIG. 9 is an electrical schematic for use with the sink of FIG. 1.

Water supply opening 120 and nozzles 130 are operated via solenoid valves 140, 142 shown schematically in FIG. 9. A water supply in the form of a cold water supply 60 and a hot water supply 62 merge at a mixer valve 64. The mixed water is in fluid communication with sprayer discharge 52, which is operated via a mechanically operated trigger valve 55 and with solenoid valves 140, 142. Which are both powered by a power supply 144, such as a battery. A first switch 146 operates solenoid valve 140 to provide fluid communication to manifold 132 which, in turn, provides fluid communication to nozzles 130. A second switch 148 operates solenoid valve 142 to provide fluid communication to faucet 50 or water supply opening 120. Optionally, switches 146, 148 can be embedded in a wall, such as rear wall 106 as "touch switches" to operate solenoid valves 140, 142 so that the switches are not visible to the user.

To operate sink 100, if the user desires to operate nozzles 130, the user presses switch 146, which opens solenoid 140 and allows for fluid flow from pressurized water supply 54 to nozzles 130. If the user desires to operate faucet 50 or water supply opening 120, the user presses switch 148, which opens solenoid 142 and allows for fluid flow from pressurized water supply 54 to faucet 50 or water supply opening 120. To stop the flow of water, the user again presses the appropriate switch 146, 148.

It will be further understood that various changes in the details, materials, and arrangements of the parts which have been described and illustrated in order to explain the nature of this invention may be made by those skilled in the art without departing from the scope of the invention as expressed in the following claims.

We claim:

1. A splashless sink assembly comprising:

a basin formed by a front wall, a rear wall, a bottom, a first side wall, and a second side wall disposed opposite the first side wall, the first and second side walls each extending upwardly from the bottom to the open top at an angle oblique relative to the a bottom;

an open top located above the bottom;

a plurality of water discharge connections extending through each of the first side wall and the second side wall, wherein each of the plurality of water discharge connections terminate in a nozzle on an inside portion of the sink;

a water manifold in fluid communication with the plurality of water discharge connections;

a pressurized water supply connection;

a sprayer discharge having a mechanically operated trigger valve;

a water supply opening extending through the rear wall;

a four-way connector in fluid communication with the pressurized water supply connection the water manifold, the first plurality of water discharge openings, the water supply opening, and the sprayer discharge such that a first fluid path is provided between the pressurized water supply connection, the water manifold and the first plurality of water discharge connections, a second fluid path is provided between the pressurized water supply connection and the water supply opening, and a third fluid path is provided between the pressurized water supply connection and the sprayer discharge;

a first electrically controlled valve electrically connected to a power supply and a first switch and disposed in the first fluid path between the four-way connector and the first plurality of water discharge connections and configured to close fluid communication between the connector and the first plurality of water discharge connections; and a second electrically controlled valve electrically connected to the power supply and a second switch and disposed in the second fluid path between the four-way connector and the water supply opening and configured to close fluid communication between the connector and the water supply opening.

2. The splashless sink according to claim 1, wherein the oblique angle comprises an acute angle.

3. The splashless sink according to claim 2, wherein the acute angle is about 82 degrees.

4. The splashless sink according to claim 1, further comprising a second plurality of water discharge connections extending through the second side wall.

5. The splashless sink according to claim 4, wherein the second plurality of water discharge connections are offset relative to the first plurality of water discharge connections.

6. The splashless sink according to claim 1, wherein the front wall and the rear wall are each generally trapezoidally shaped, disposed opposite the front wall.

7. The splashless sink according to claim 6, wherein the open top extends over at least a portion of a perimeter of the basin.

8. A splashless sink assembly comprising:

a basin formed by a front wall, a rear wall, a left side wall, a right side wall, and bottom, the left and right side walls extending oblique relative to a vertical direction the rear wall connecting the left and right side walls to each other;

a plurality of water discharge connections extending through the each of the left and right side walls;

a water supply opening extending through the rear wall;

a water manifold in fluid communication with the plurality of water discharge connections;

a sprayer discharge having a mechanically operated trigger valve;

a four-way connector in fluid communication with a pressurized water supply, the water manifold the plurality of water discharge connections, the water supply opening, and the sprayer discharge such that a first fluid path is provided between the pressurized water supply and the water manifold, a second fluid path is provided between the pressurized water supply and the water supply opening, and a third fluid path is provided between the pressurized water supply and the sprayer discharge;

a first electrically controlled valve electrically connected to a power supply and a first switch and disposed in the first fluid path between the four-way connector and the plurality of water discharge connections and configured to close fluid communication between the connector and the plurality of water discharge connections; and a second electrically controlled valve electrically connected to the power supply and a second switch and disposed in the second fluid path between the four-way connector and the water supply opening and configured to close fluid communication between the connector and the water supply opening.

9. A splashless sink assembly consisting of:

a basin formed by a front wall, a rear wall, a left side wall, a right side wall, and bottom;

a plurality of water discharge connections extending through the side walls;

a water manifold in fluid communication with the plurality of water discharge connections;

a water supply opening extending through the rear wall;

a sprayer discharge having a mechanically operated trigger valve;

a four-way connector in fluid communication with a pressurized water supply, the water manifold, the water supply opening, and the sprayer discharge such that a first fluid path is provided between the pressurized water supply and the water manifold, a second fluid path is provided between the pressurized water supply and the water supply opening, and a third fluid path is provided between the pressurized water supply and the sprayer discharge;

a first electrically controlled valve electrically connected to a power supply and a first switch and disposed in the first fluid path between the four-way connector and the water manifold and the plurality of water discharge connections and configured to close fluid communication between the connector and the plurality of water discharge connections; and a second electrically controlled valve electrically connected to the power supply and a second switch and disposed in the second fluid path between the four-way connector and the water supply opening and configured to close fluid communication between the connector valve and the water supply opening.

* * * * *